US006416377B1

(12) United States Patent
Bart

(10) Patent No.: US 6,416,377 B1
(45) Date of Patent: Jul. 9, 2002

(54) BUBBLE BLOWING DEVICE WITH MULTI-COLOR EFFECTS AND VARYING AIR FLOW PRESSURE

(76) Inventor: Philip D. Bart, 4331 Cararambola Cir. N., Coconut Creek, FL (US) 33066

( * ) Notice: Subject to any disclaimer, the term of this patent is extended or adjusted under 35 U.S.C. 154(b) by 0 days.

(21) Appl. No.: 09/912,582

(22) Filed: Jul. 26, 2001

(51) Int. Cl.[7] ..... A63H 33/28
(52) U.S. Cl. ..... 446/15
(58) Field of Search ..... 446/15–21

(56) References Cited

U.S. PATENT DOCUMENTS

| | | | | | |
|---|---|---|---|---|---|
| 2,560,582 | A | * | 7/1951 | Limber | 446/18 |
| 2,700,845 | A | * | 2/1955 | Arliss | 446/18 |
| 2,802,295 | A | * | 8/1957 | Larin | 446/21 |
| 4,128,962 | A | * | 12/1978 | Anderson | 446/15 |
| 5,462,469 | A | * | 10/1995 | Lei | 446/15 |

FOREIGN PATENT DOCUMENTS

| | | | | | |
|---|---|---|---|---|---|
| GB | 2042350 | A | * | 9/1980 | A63H/33/28 |
| GB | 2223687 | A | * | 4/1990 | A63H/33/28 |

* cited by examiner

*Primary Examiner*—Jacob K. Ackun
*Assistant Examiner*—Bena B. Miller
(74) *Attorney, Agent, or Firm*—M. K. Silverman

(57) ABSTRACT

The invention comprises a bubble-blowing device having a reservoir of soapy-like fluid, a rotor with apertures rotating downwardly in a trigger controllable manner into said fluid and then advanced upwardly to a discharge position. There is also provided a special purpose electric fan or blower, the operation of which is synchronized with rotation of the apertured rotor for the directing of a variable velocity flow of air to fluid-filled apertures of the rotor within the device's discharge area. Actuation by the trigger concurrently actuates the rotor, the special purpose blower, and a multi-colored lens assembly circumferentially surrounding a light source such that a different color of the lens assembly is rotated in front of the light source in synchronization with each rotational advance of the apertured rotor caused by trigger actuation. The simultaneous energizing of the fan produces a stream of bubbles from the aperture of the rotor in the gun's discharge position concurrently with an advance of the circumferential lens assembly about the light source to generate a different color effect as a function of each new actuation the trigger. There are preferably provided lens regions of three different colors while the bubble fluid holding rotor is typically provided with six apertures. Providing two sequences of three different colors per sequence when complete rotation of a rotor has been effected as a result of six actuations of the trigger of the bubble-blowing device. A sound chip may be actuated in combination with the bubble-blowing function.

9 Claims, 6 Drawing Sheets

BUBBLE BLOWING DEVICE WITH MULTI-COLOR EFFECTS AND VARYING AIR FLOW PRESSURE

BACKGROUND OF THE INVENTION

1. Area of Invention

The invention relates to a children's toy for the production of bubbles produced from a soap-like solution.

2. Prior Art

This invention relates to the field of bubble blowing devices that have been popular as children's toys for many years. More particularly, this invention constitutes an improvement of my U.S. Pat. No. 4,423,565 (1984) entitled Bubble-Blowing Device with Varying Airflow Pressure. The efficiency or effectiveness of devices of this type is a function of the rate at which bubbles can be made and the quality of the bubble solution itself. These factors are in turn a function of more technical considerations, these including that of how fast and how much air the user may blow into the bubble film, the rate impact of the air against the bubble film, and the rate of re-iteration or re-dipping of a bubble producing aperture of the device within a bubble solution reservoir thereof. There are, as well, other less direct factors which bear upon the rate and quality of bubble production, these including temperature, humidity, altitude and movement of the ambient air atmosphere into which the bubbles are blown and formed.

In the prior art, particularly inclusive of my said 1984 invention, bubble-blowing devices did not include a practical means of producing bubbles of different colors other than through the introduction of pigments of differing colors into the bubble film solution itself. Therefore, there has not existed any practical means of incorporating a color effect into the bubble output of bubble blowing devices that employ soapy-like fluids for the production of the bubble membrane. More generally, there has not existed any generalized means for providing illumination to bubbles of a bubble-blowing device to thereby render a toy in accordance therewith usable by a child at night or in conditions of darkness, as well as during the day. Further, there has not existed in the art the incorporation of a voice chip or sound capability that attempts to add a dimension of reality to the design concept of bubble blowing devices of the present kind. These and other areas of interest in the art are addressed in the present invention.

SUMMARY OF THE INVENTION

The invention comprises a bubble-blowing device having a reservoir of soapy-like fluid, a rotor with apertures rotating downwardly in a trigger controllable manner into said fluid and then advanced upwardly to a discharge position. There is also provided a special purpose electric fan or blower, the operation of which is synchronized with rotation of said apertured rotor for the directing of a variable velocity flow of air to fluid-filled apertures of said rotor within the device's discharge area. Actuation by said trigger concurrently actuates said rotor, said special purpose blower, and a multi-colored lens assembly circumferentially surrounding a light source such that a different color of said lens assembly is rotated in front of the light source in synchronization with each rotational advance of the apertured rotor caused by trigger actuation. Thereby, the simultaneous energizing of the fan produces a stream of bubbles from the aperture of the rotor in the discharge position concurrently with an advance of the circumferential lens assembly about the light source in order to thereby generate a different color effect as a function of each new actuation the trigger. There are preferably provided lens regions of three different colors while the bubble fluid holding rotor is typically provided with six apertures. Thereby, providing two sequences of three different colors per sequence when complete rotation of a rotor has been effected as a result of six actuations of the trigger of the bubble blowing device.

It is accordingly an object of the present invention to provide an improved bubble blowing device for children in which color effects are imparted to bubbles as they are ejected from a nozzle of the device.

It is another object to furnish a device of the above type in which multiple effects, inclusive of audio effects, may be synchronized with actuation of the device trigger.

It is a further object of the invention to provide a device of the above type that may be adapted for use in differing conditions of temperature, humidity, altitude and blow velocity.

It is still another object to provide an apparatus of the above type capable of forming and ejecting large numbers of bubbles at a rapid rate.

The above and yet other objects and advantages of the present invention will become apparent from the hereinafter set forth Brief Description of the Drawings and Detailed Description of the Invention included herewith.

DETAILED DESCRIPTION OF THE INVENTION

Figure 6:
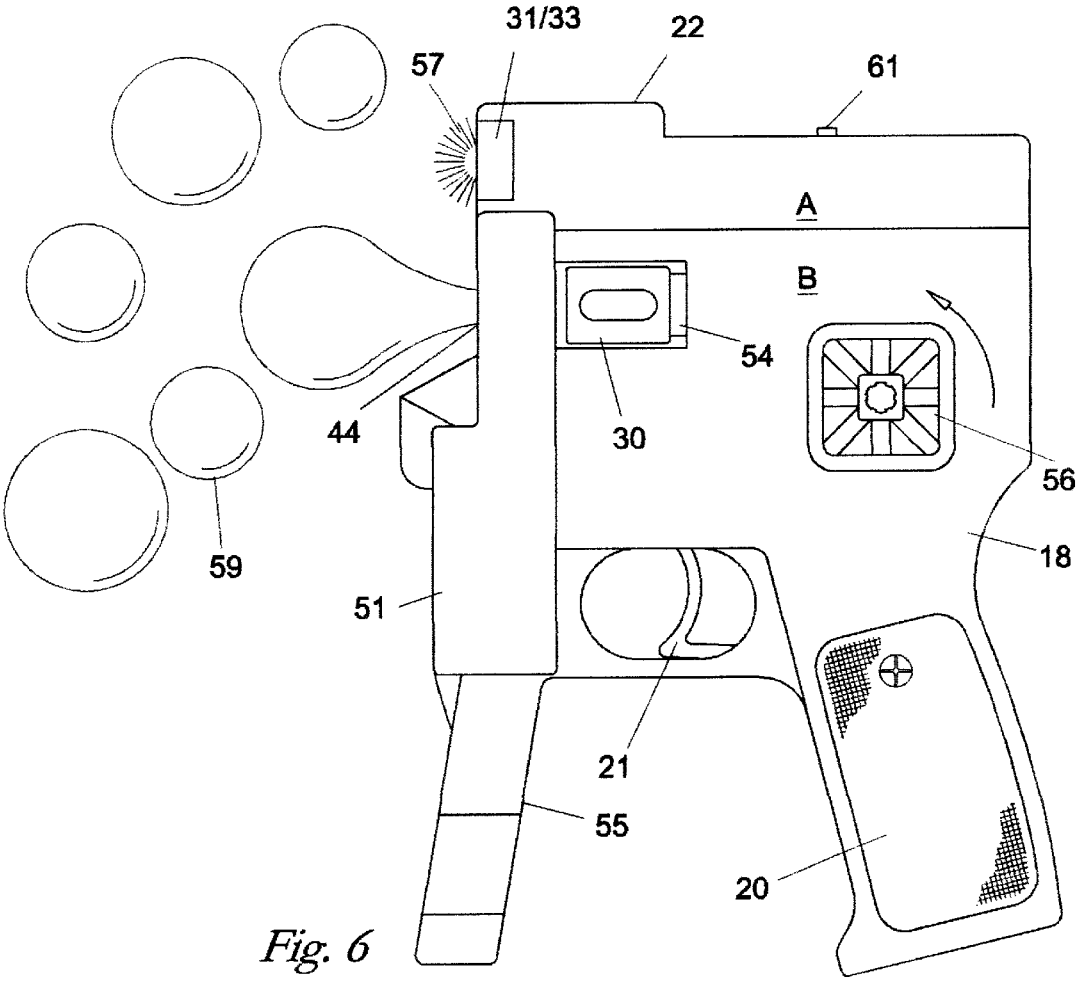
FIG. 6 is a side elevational view of the inventive system.

As may be appreciated with reference to the vertical cross-sectional view of FIG. 1 and the side elevational view of FIG. 6, the inventive bubble-blowing device is, more particularly, defined by an upper housing A which contains a variable light color assembly, more fully described below, and a lower housing B within which is contained a bubble generating assembly. Therein, housing A is snap-fittable to and from housing B.

Figure 8:
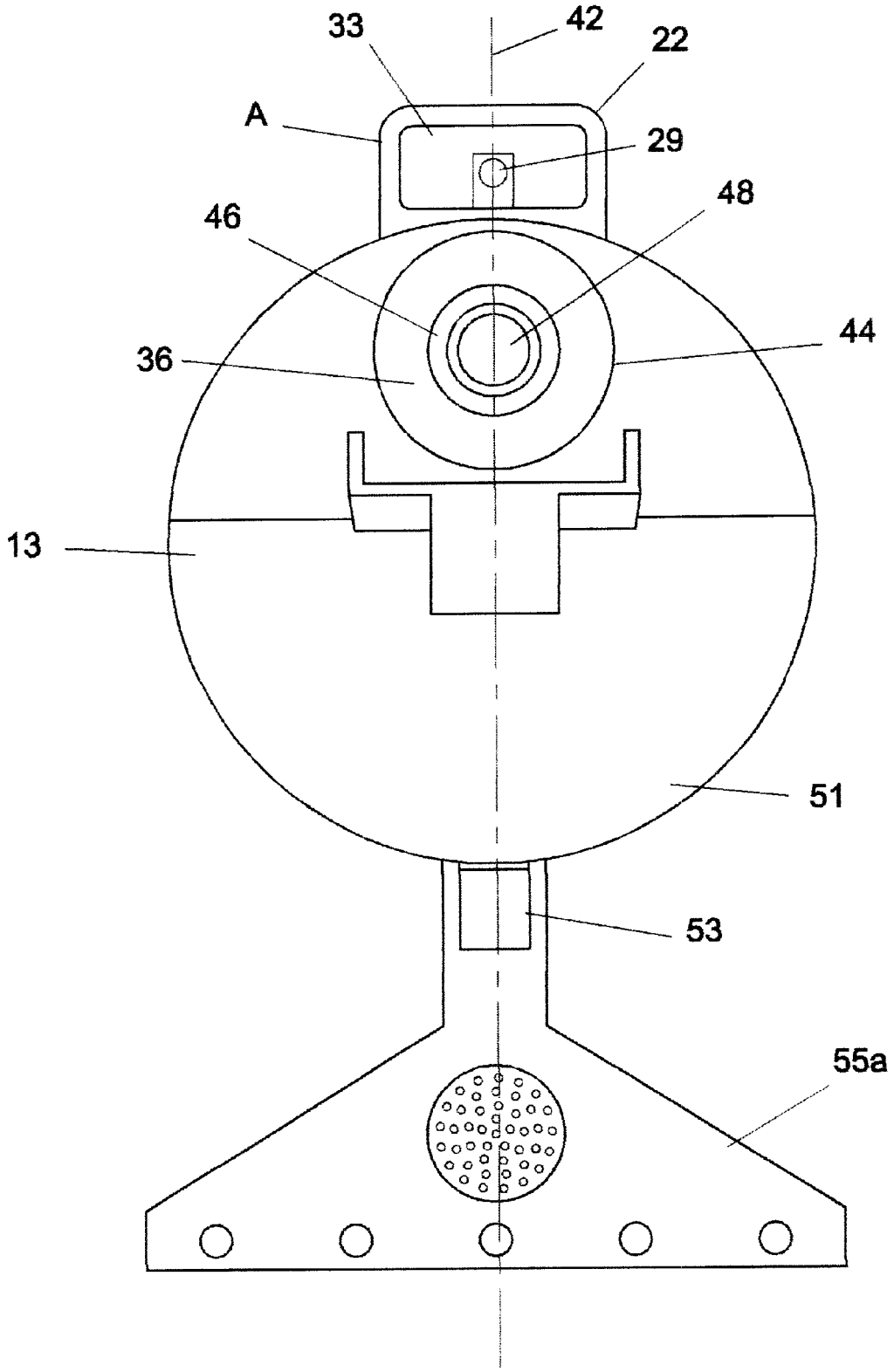
FIG. 8 is a front elevational view of the inventive device.

The bubble generating portion of the system more particularly includes a housing 18, a rear handle 20, a trigger 21, a fluid chamber or reservoir 50, a filling inlet 53 (see FIG. 8), and a front handle 55.

Figure 1:
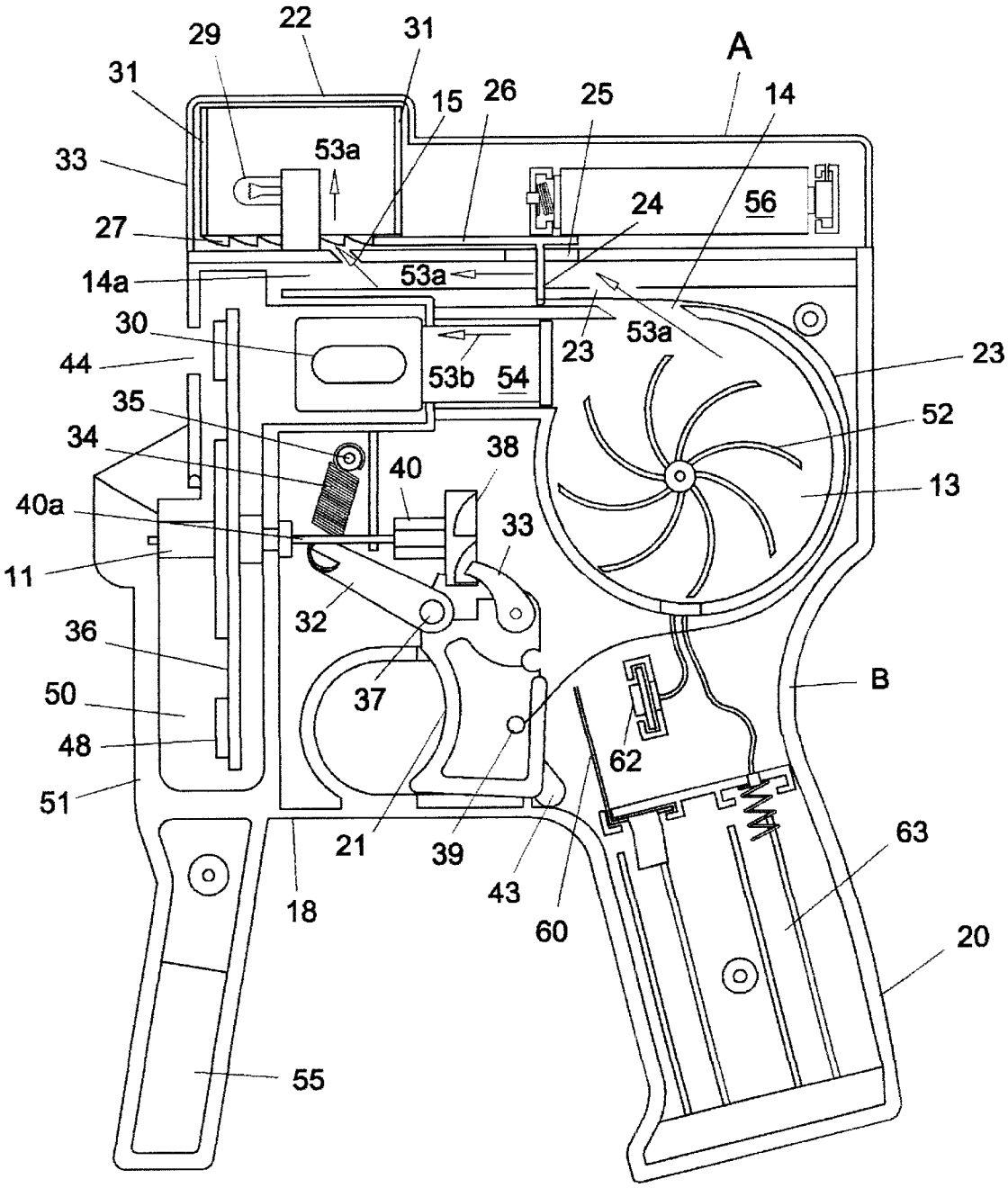
FIG. 1 is a vertical cross-sectional view showing the operative elements of my inventive bubble blowing device.

In FIG. 1 are illustrated the basic and internal components of the bubble generating portion of the device, all of which are mounted within housing 18 or B. That is, said trigger 21 is in pivoted at pivot 37 with spring tensioning element 32, an end of which is pivoted at pivot 37 to the trigger and the other of which is secured to one end of spring 34, the other end 35 of which is secured to housing 18. Thereby, the combination of tensioning element 32 and spring 34 co-act with pivot point 37 of trigger 21 to provide a desired degree of tension or resistance to the trigger.

Figure 9:
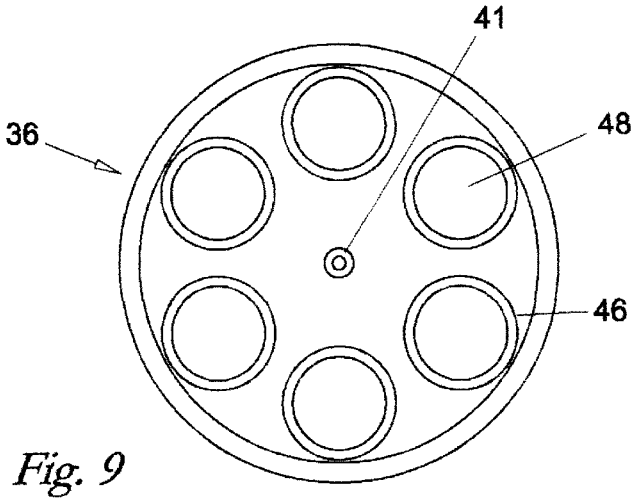
FIG. 9 is a front elevational view of the bubble-forming rotor of the invention.

Pivotally dependent from an upper right area of trigger 21 is pawl 33 which, responsive to squeezing of trigger 21 in the direction of point 39 will cause said pawl to effect a rotational advance of ratchet 38 having six teeth, and its associated spool 40. Such rotation will be integrally transmitted through rod 40*a,* thereby causing rotation of hub 41. Journalled upon hub 41 is bubble disk 36 (see also FIG. 9) which is characterized by a plurality of apertures 48. The walls of said apertures are defined by frusto-conical segments 46 that have been found to facilitate effective formation of bubbles, as is more fully set forth below. Accordingly, a user of the present system, through depression of trigger 21 and, thereby, rotation thereof about pivot point 37, will effect a pawl-and-ratchet step rotation of rod 40*a* and, therewith, step rotation of bubble disk 36 of an extent (60 degrees) equal to each polar segment transcribed by each of the tooth of the ratchet 38. As such, one is able to control the extent of rotation of bubble disk 36 and, thereby, assure that at least three of the six apertures 48 of the disk are immersed in the bubble reservoir 50 at any point in time. Further, the polar segment transcribed by each tooth of the ratchet 38 also assures that the center of each aperture, when it has been advanced into its bubble generating position, that is, advanced into alignment with bubble housing outlet 44 (see also FIG. 8) will also be in alignment with a vertical axis 42 of the system. It is thereby to be appreciated that the pawl and ratchet 33 and 38 respectively operate not only to assure accurate segments of polar rotation of bubble disk 36 but, as well, to establish proper position of the bubble apertures 48 relative to horizontal and vertical axes of the present system which intersect at bubble outlet 44.

Figure 7:
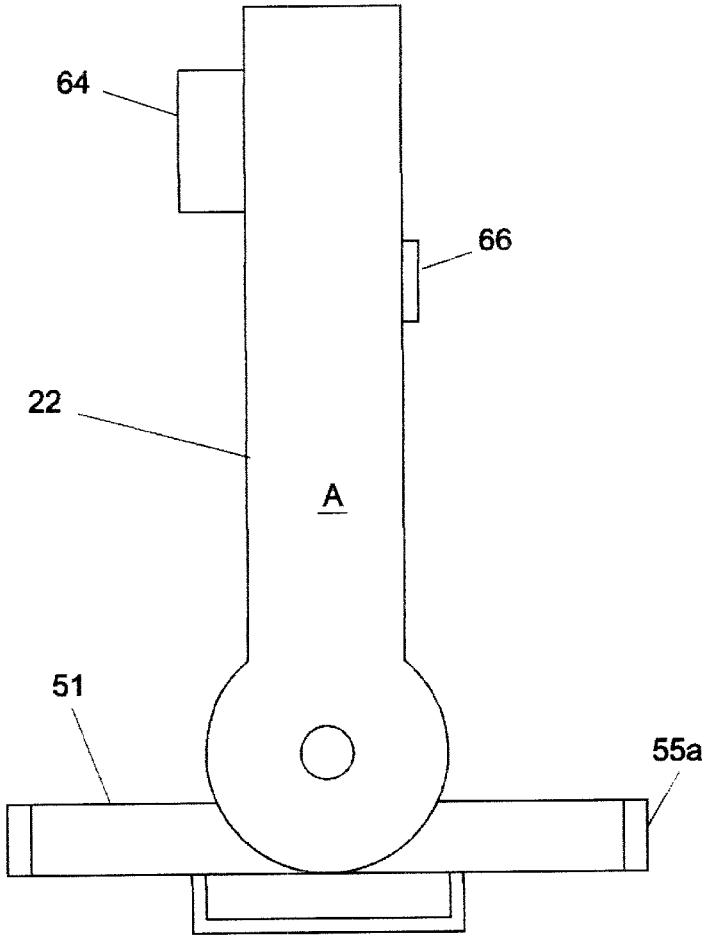
FIG. 7 is a top plan view thereof.

The depression or rotation of trigger 21 relative to pivot point 37 will also effect contact between protruding element 43 of the trigger and reed switch 62 which, in turn, will contact electrode 62 thereby closing a circuit inclusive of batteries 63, located within handle 20, such that power is provided to system motor 64 (see FIGS. 1 and 7), the output of which actuates squirrel blower 52 within cylindrical chamber 13 which generates two streams of air, namely 53 and 53*b*. Stream 53*a* which passes thru channel 14 of housing B, into a passageway 14*a* thereof, and thru aperture 15 (see FIG. 1A) within the lower surface of housing A. This aperture may be baffled to better control the directionality of air stream 53*a*. Therefrom air stream 53*a* enters a cylindrical light carousel (described below) to effect the cooling of the light source 29. Blower 52 also causes a stream of air 53*b* to advance down air discharge channel 54. In this arrangement, airflow must accumulate from zero at a time before trigger 21 is pulled to a maximum level dependent upon how long the trigger is held depressed. Accordingly, as the air stream 53*b* approaches, a fluid membrane covered rotor aperture 48 is aligned with air outlet channel 44, this known as the bubble position. The leading air, shown at arrow 53*b,* at first moves slowly and is under only slight pressure. However, air flow speed and pressure rapidly increase such that a stream of many bubbles is produced from a single bubble fluid membrane across aperture 48 until the fluid of the membrane is so consumed that no further bubbles can form.

When the trigger is released, and then re-depressed, ratchet 38 will again revolve one polar step (60 degrees) thereby bringing a fresh fluid-filled aperture 48 into alignment with the air discharge channel 54 and air outlet opening 44 of the system.

This sequence of steps in the operation of the bubble-generating device may be repeated until fluid reservoir is so depleted that fluid membrane ceases to form and fill the rotor apertures. In the preferred embodiment, as above described, a very large number of bubbles, in the range of 25 to 100 is formed with each trigger actuated sequence between its release and re-pull positions. It has been found that two 1.5 volts AA batteries 63 in series are sufficient to energize blower motor 64 which operates in a range of 4000 to 8000 rpm. The soapy fluid used within reservoir 50 may comprise any of a commercial bubble solution, baby shampoo, liquid soap typical in home use, and other equivalent fluids.

Bubble disk 36 will typically exhibit six apertures, each having a diameter of slightly less than one inch. See FIG. 9. Ribs, rims or veins may be employed to define boundaries about each aperture if the above referenced frusto conical means 46 are not employed. The height of such means extending transversely of the bubble disk is typically in a range of 0.1 to 0.6 inches.

It is to be appreciated that a noise-making element, such as a voice chip, may optionally be attached to the trigger or to the blower to simulate the sound of machine gun fire or to provide any of a variety of sounds such as bubble popping.

Figure 4:
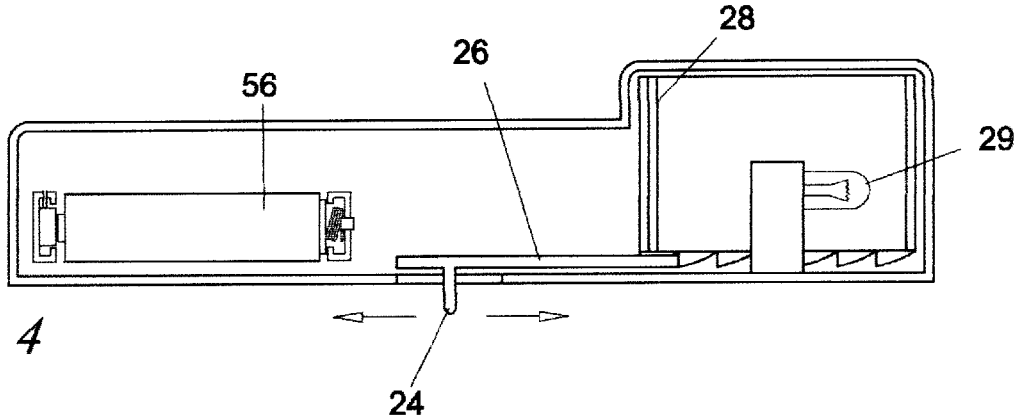
FIG. 4 is a vertical cross-sectional view of the light and color carousel assembly taken through Line 4—4 of FIG. 2.
Figure 5:
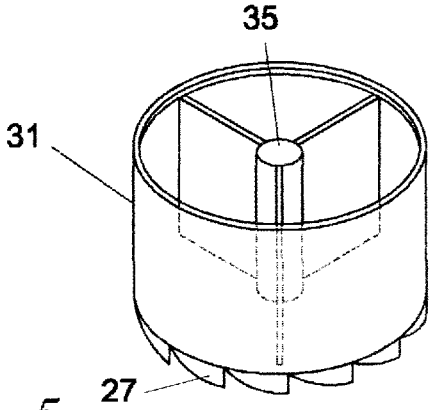
FIG. 5 is a perspective schematic view showing the light carousel assembly as a stand-alone element.

While the above-described structure reflects an assembly of improved efficiency to that of the invention of my said U.S. Pat. No. 4,423,561, the essential improvement of the device is, however, reflected in the rotating light carousel of housing A which is shown in separate elevational view in FIG. 2, in horizontal cross-sectional view of FIGS. 1A and 3 in FIG. 3 and in vertical cross-sectional views in FIG. 4. Housing A more particularly includes said cylindrical carousel 31 having a vertical axle 35 upon which is also journalled a circular ratchet 27. See also FIG. 5. At the rear of housing A is provided two double A batteries 56 which are used to power a halogen bulb 29 located in front of axle 35.

Figure 3:
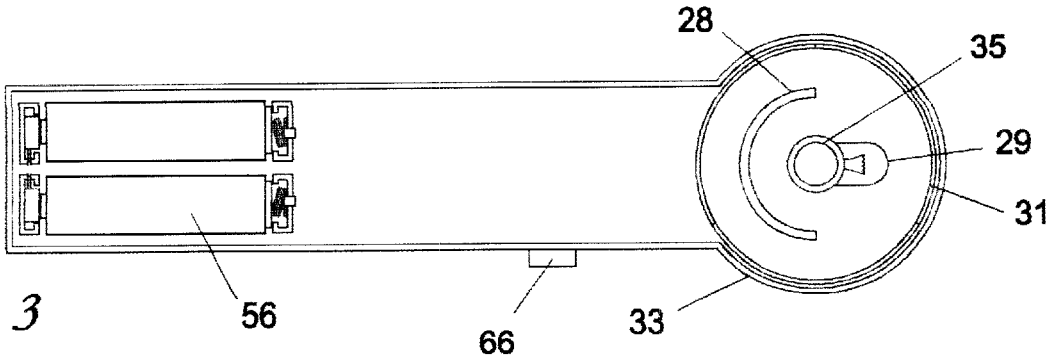
FIG. 3 is a horizontal cross-sectional view taken through Line 3—3 of FIG. 2.
Figure 3A:
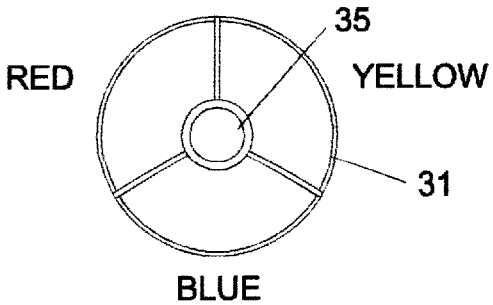
FIG. 3A is an enlarged top view of the light and color lens assembly.
Figure 4A:
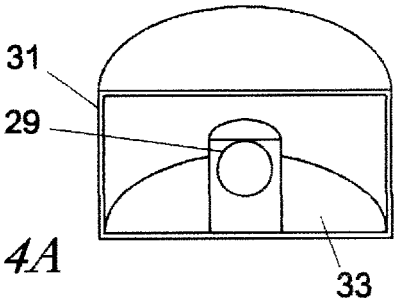
FIG. 4A is a front view of said carousel.

As may be noted with reference to FIGS. 3 and 3A, internal to carousel 22 is said carousel 31 which consists of three cylindrical segments, namely, red, yellow and blue segments, such that one segment is transcribed by carousel window 33. A reflector 28 may be placed inside carousel 31 behind bulb 29 to enhance the effect thereof. See FIG. 4A.

To synchronize the rotation of carousel 31 with the rotation of bubble disk 26, there is provided a pushrod cable 23 which is a substantially rigid element which originates, at a first end thereof, at point 39 of trigger 21. As may be noted with reference to the right side of the sectional view of FIG. 1, cable 33 then extends around the housing of squirrel fan 52 until the opposite end of cable 23 is secured to vertical element 24 of pushrod 26. See also FIG. 4. Thereby it may be appreciated that pushrod 26 enjoys a range of motion which is defined by the horizontal extent of slot 25 within the uppermost horizontal surface of housing 18 of Part B of the assembly. In this arrangement, pushrod 26 cannot advance circular pawl 27 of carousel 31 unless it is sufficiently advanced to the left. This can only occur when trigger 21 is sufficiently depressed such that cable 23 can advance vertical portion 24 of pushrod 26, to thereby, at a leftmost end thereof, function as a pawl relative to the circular ratchet 27 of the light carousel. Through this arrangement, rotation of the colored lenses of carousel 31 may be precisely synchronized with rotation of bubble disk 36, an essential result of which is to coordinate changes of color of light 57 (see FIG. 6) refracted within soap bubbles 59. It has been found that such refraction will produce a prismatic effect so that many different colors will be observed within the dozens of bubbles which are ejected from output 44 during a given depression of the trigger 21.

It is also noted that air stream 53*a,* if of sufficient strength, can be used to effect rotation of carousel 31 even if the pushrod 26 is not advanced by cable 23.

If one wishes to change the size of bubbles which are emitted from the inventive bubble-blowing device, nozzle 30 may be moved horizontally, that is, moving nozzle 30 of air discharge channel 54 closer to blower 52 will increase bubble size while moving it away from blower 42 will produce the opposite effect.

The present system is also provided with an air intake baffle 56 (see FIG. 6) by which the amount of air drawn into the device may be controlled. That is, at higher altitudes, more air is required to provide the same resultant air mass as an output from blower 52 than is required to achieve comparable air mass at, for example, sea level. Also, adjustable baffle 56 may be used to draw larger quantities of air into the system when battery power has diminished and thereby reduced the rate of rotation of blower 52. That is, an increased quantity of air introduced into the system can compensate for reduction in rate of rotation of squirrel fan blower 52.

There may optimally be provided a photoelectric eye 61 (see FIG. 6) which will automatically close a circuit between batteries 56 and halogen bulb 59 when the level of ambient light falls below a predetermined level. Thereby, for purposes of outdoor use by a child, power will be preserved, that is, not used, during conditions of substantial daylight but, rather, will only function when ambient light, whether indoor or outdoor, falls below a given level.

Figure 1A:
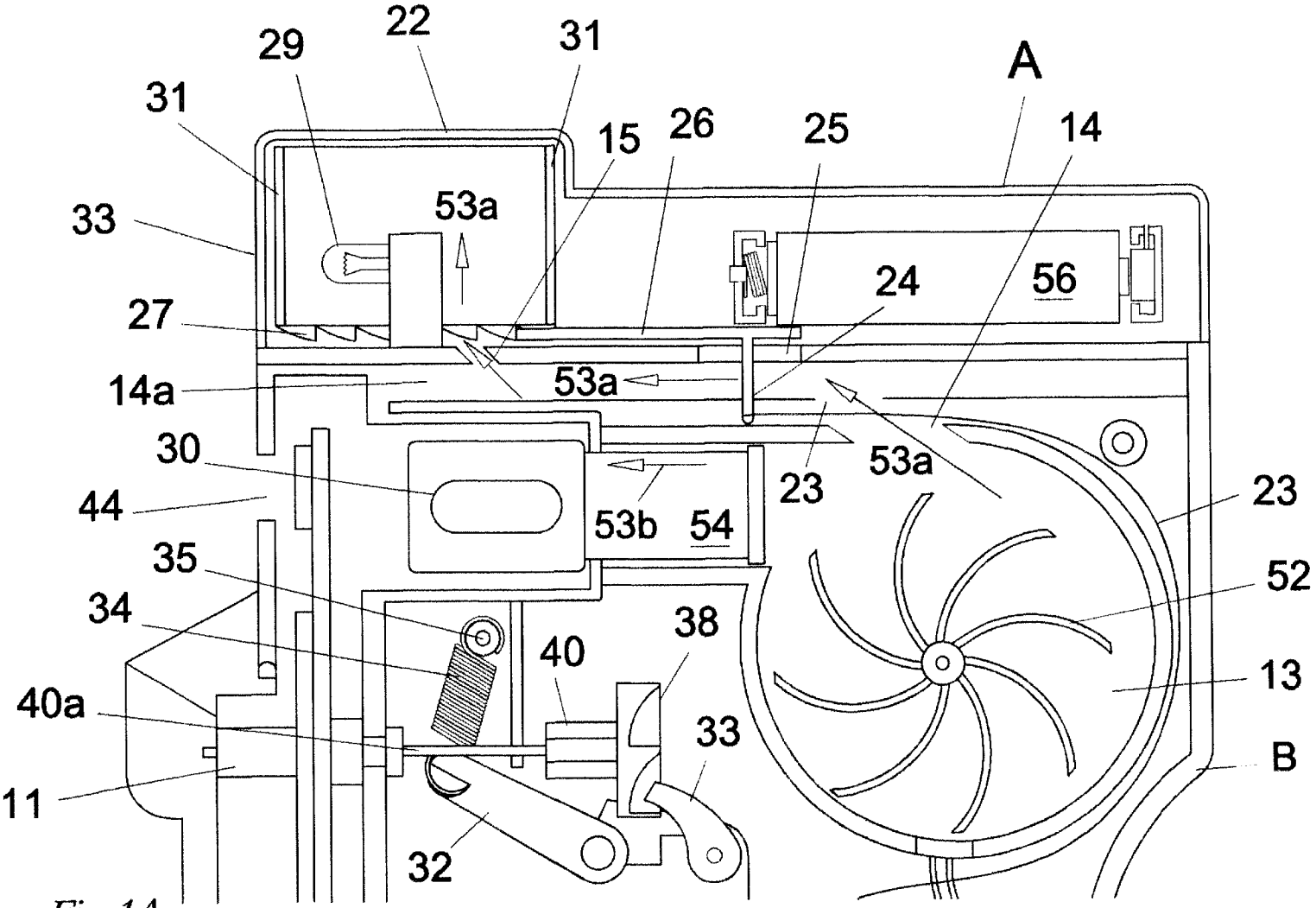
FIG. 1A is an enlarged view of the upper right portion of FIG. 1.
Figure 2:
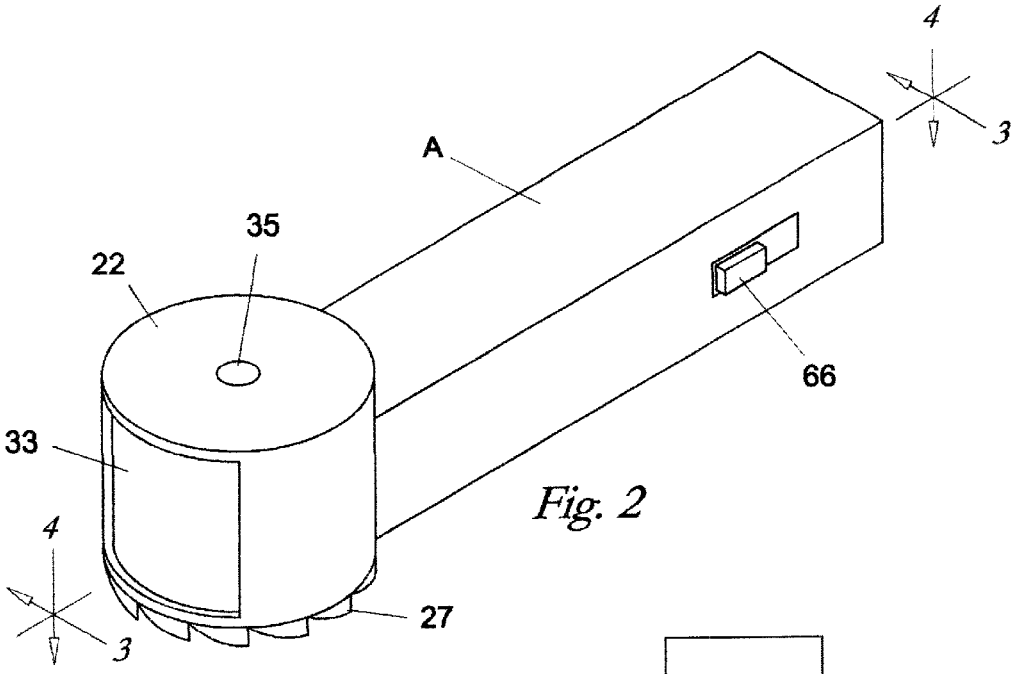
FIG. 2 is a perspective view of the light and color lens carousel assembly of the invention.

It has been found that operation of the instant bubble device will be most successful if the trigger is pulled, released, and then re-pulled, at intervals of approximately one to three seconds, this to bring freshly filled fluid membrane to the bubble apertures and therefore to air stream 53*b* (see FIGS. 1 and 1A). Because of the many factors influencing bubble formation and bubble breakdown, especially including the particular type of soapy fluid selected and the size and power of air stream 53*b,* the optimum rate of trigger actuation will vary. Accordingly, an aspect of experimentation by the user is helpful in learning the rate of trigger depression which is optimal for a given bubble solution and altitude.

It is to be appreciated that light carousel ratchet 27 may be designed in such a fashion so that halogen or other light source 29 is actuated intermittently, as opposed to continuously. That is, light source 29 may, in a given design of ratchet means 27, or of circuitry associated with light source 29 and battery 56, thereby emit light and thereby the above referenced color and prismatic effect, for a defined segment of each period of trigger depression. Alternatively, the housing A may be programmed such that the above-described visual effect occurs every other time that the trigger is depressed.

Another design option is that of making the entire housing B, that is, housing 18, entirely transparent to maximize the refractive and prismatic effect of the system when it is used in a darkened ambient. A further design option is that of using multiple bulbs of lamps, each corresponding to a different color to thereby obviate the need for a multi-colored disk of the type shown in FIGS. 3, 3A and 5.

It is to be further appreciated that housings A and B (see FIG. 6) may be readily integrated such that the light carousel assembly has the appearance of complete integration within a single housing.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth herein.

I claim:

1. An improved bubble-blowing device having a reservoir of a soapy-like fluid, a power source, a rotor with apertures rotating downwardly in a trigger actuated manner into said fluid and then advancing upwardly to a discharge position, the device including an electric blower, the operation of which is synchronized with rotation of said apertured rotor for the directing of a variable velocity flow of air thru fluid-filled apertures of said rotor within the device's discharge area, in which the improvement comprises:

(a) a multi-colored lens assembly rotationally surrounding a light source; and (b) means for rotating a different color of said lens assembly in front of said light source in synchronization with each rotational advance of said apertured rotor caused by trigger actuation, and (c) a power source for said light source;

whereby the energizing of said blower produces a stream of bubbles from the aperture of said rotor concurrently with an advance of the circumferential lens assembly about the light source, thereby generating a different color effect upon each new actuation of the trigger.

2. The device as recited in claim 1, in which said rotating means comprises:

a trigger selectably movable between a pulled and a released position, said trigger coupled to switch means for actuation of said fan and to means for rotational advance of said apertured rotor, said trigger also coupled to means for said synchronized advance of said multi-colored assembly.

3. The device as recited in claim 2 in which said rotor comprises:

a web rotatable about an axis therethrough, said web defining therein a plurality of apertures located on a circular path about and radially spaced from said axis, said rotor causing each of said apertures followed by its next adjacent aperture to periodically dip into said reservoir and subsequently moved to said bubble position.

4. The device as recited in claim 3 in which said trigger is mechanically coupled directly to said rotor, whereby each movement of the trigger from its released to its pulled position rotates said rotor an amount sufficient to move said next adjacent aperture into its bubble position.

5. The device as recited on claim 4 wherein said trigger includes a first part engaging said rotor and a second part engaging said switch means, whereby, upon movement of said trigger to its pulled position, said first part rotates one of said rotor apertures to its bubble position and said second part actuates said switch means into an on condition.

6. A device according to claim 1 wherein said source of power comprises a battery carried by said device.

7. The device as recited in claim 2 in which said blower includes a secondary air bleed and air bleed channel into said lens assembly to effect the cooling thereof.

8. The device as recited in claim 7, further comprising:

sound or noise generating means in synchronous relationship to each new trigger actuation.

9. The device as recited in claim 7 further comprising:

photoelectric means to enable a circuit including said power source of said light source.

* * * * *